United States Patent [19]

Masaki

[11] 4,023,357

[45] May 17, 1977

[54] SYSTEM TO CONTROL THE RATIO OF AIR TO FUEL OF THE MIXTURE DELIVERED TO AN INTERNAL COMBUSTION ENGINE

[75] Inventor: Kenji Masaki, Yokohama, Japan

[73] Assignee: Nissan Motor Co., Ltd., Yokohama, Japan

[22] Filed: Dec. 22, 1975

[21] Appl. No.: 643,127

[30] Foreign Application Priority Data

Dec. 24, 1974 Japan ..... 50-1420

[52] U.S. Cl. ..... 60/276; 60/285; 123/119 EC; 261/121 B

[51] Int. Cl.[2] ..... F01N 3/15; F02B 33/00

[58] Field of Search ..... 60/276, 285; 123/119 EC, 119 R; 261/121 B, DIG. 74

[56] References Cited

UNITED STATES PATENTS

| | | | |
|---|---|---|---|
| 3,906,910 | 9/1975 | Szlaga | 123/119 R |
| 3,921,612 | 11/1975 | Aono | 123/119 EC |

*Primary Examiner*—Douglas Hart

[57] ABSTRACT

The rate of additional air delivered to an engine slow fuel passage is controlled in response to an exhaust gas sensor output representative of the air/fuel ratio of the input charge into the engine. An additional air bleed passage into the carburetor has two inlets of different diameters, the larger one of which is provided with a valve operable to close the larger inlet in accordance with a sensed idle condition of the engine.

6 Claims, 4 Drawing Figures

SYSTEM TO CONTROL THE RATIO OF AIR TO FUEL OF THE MIXTURE DELIVERED TO AN INTERNAL COMBUSTION ENGINE

This invention generally relates to a system to control the ratio of air to fuel of an air/fuel mixture being charged into an internal combustion engine and in particular to an electric feed back control system in which the air/fuel ratio at an intake system of the engine is controlled in accordance with a signal representing concentration of a sensed component in exhaust gases which depends on the controlled air/fuel ratio.

In order to control noxious exhaust emissions, a variety of additional cleanup devices has been proposed such as thermal reactors or catalytic converters. For some catalysts, it has been observed that the simultaneous elimination of three noxious exhaust emissions, that is, of hydrocarbons and carbon monoxide and of nitrogen oxides is obtained if the engine air/fuel ratio is maintained at a stoichiometric value. The range within which elimination of all three of these emissions is efficient is very narrow about the stoichiometric value. Precise control of the air/fuel ratio is therefore required for most efficient operation of the catalyst.

An electronic feed back control system is being exploited as most effective to meet such demand for precise air/fuel ratio control. In such system, an exhaust gas sensor measures the concentration of a component of exhaust gases such as the concentration of oxygen varying with the air/fuel ratio of the mixture and produces an electric signal representative of the sensed concentration of the component. The signal is processed in an electronic circuit or controller and is then applied to one or more electromagnetic valves, which control additional air and/or fuel delivery to the engine in accordance with the magnitude of the electric signal. Such control system has excellent properties like increased accuracy in obtaining desired values of the controlled air/fuel ratio, reduced sensitivity to internal and external disturbances and others.

A general object of this invention is to further improve the electronic feed back control system of the above character to provide a more increased accuracy in controlling the air/fuel ratio in any engine running mode, particularly at idle or low speed running.

Another object of this invention is to stabilize engine running with the control system of the above at character at idle or low speed.

A specific object of this invention is to furnish an additional air passage communicating with a carburetor slow fuel passage with two inlet jets of different diameters and with a valve operable to control the inlet jet with a larger diameter in response to an idling condition.

Other objects, features and advantages of this invention will be readily understood as the detailed explanation proceeds with reference to the appended claims and drawings, in which like parts in each of the several Figures are indicated by the same reference characters, and in which:

Figure 1:
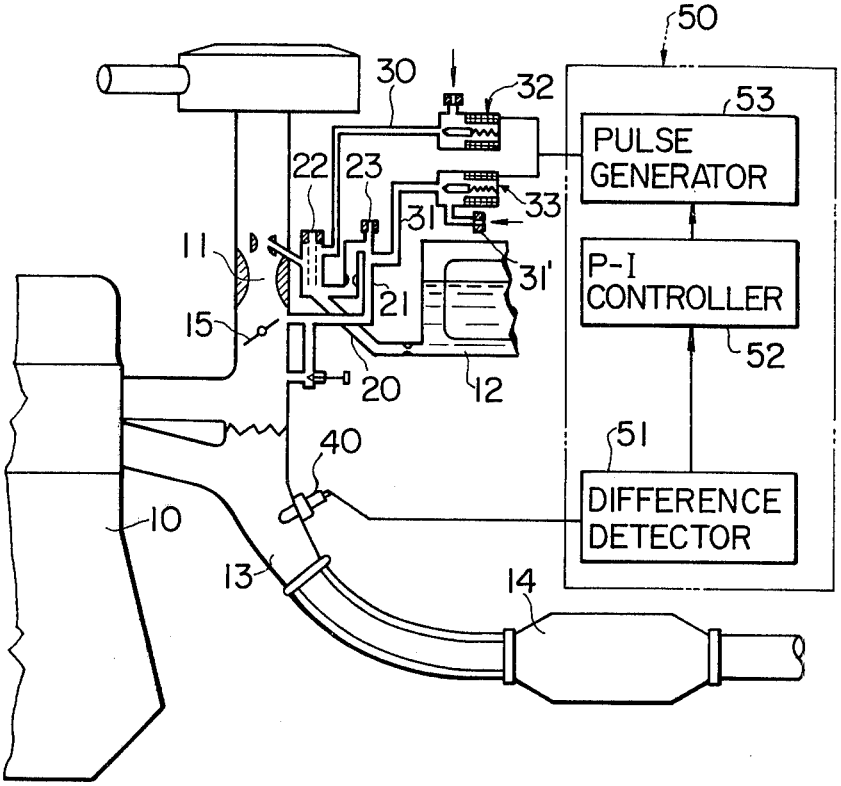
FIG. 1 PRIOR ART
FIG. 1 is a schematic view showing a prior art feed back control system.

Shown in FIG. 1 is an exemplary one of conventional feed back control systems, to which an improvement according to this invention has been made as will be apparent later. The system is shown incorporated with an engine 10 having a conventional carburetor (no number) forming part of an engine intake passage 11, a fuel source 12, an exhaust passage 13 and a catalytic converter 14 located in the exhaust passage 13. The carburetor comprises a throttle valve 15 disposed in the intake passage and a fuel delivery system consisting of a main fuel passage 20 and a slow fuel passage 21 respectively connected between the fuel source 12 and the intake passage 11. Both fuel passages 20 and 21 are respectively provided with a main air bleed 22 and a slow air bleed 23 freely opening to the atmosphere which feed air into the respective fuel passages 20 and 21 to atomize the fuel before entering the intake passage. The control system further comprises an additional air bleed passage 30 communicating with the main fuel passage 20 and another additional air bleed passage 31 communicating with the slow fuel passage 21. These passages 30 and 31 are disposed respectively parallelly with the main air bleed 22 and slow air bleed 23. Electromagnetic valves 32 and 33 are respectively located in the passages 30 and 31 to control the rates of air therethrough as will be later described in more detail.

Figure 2:
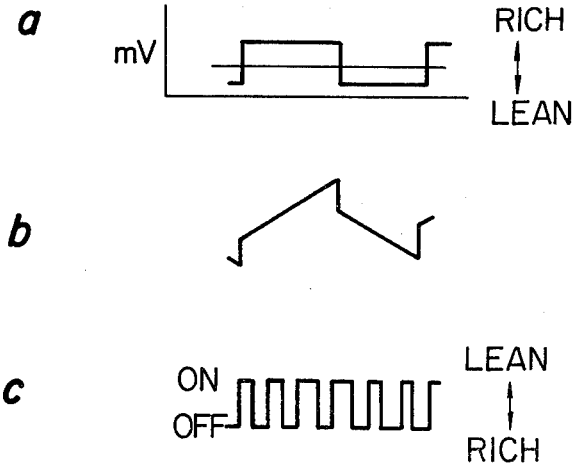
FIG. 2 is a diagram showing various waveforms generated by different elements of the system shown in FIG. 1.

There is provided a sensor 40 in the exhaust passage 13 of the engine to measure for instance the concentration of oxygen which is related to the air/fuel ratio. The sensor is typically composed of zirconium dioxide ($ZrO_2$) coated with a catalytic electrode such as platinum. It produces an electric signal in accordance with the concentration of oxygen in exhaust, as indicated by the character (a) of FIG. 2, and is applied to an electronic control circuit generally depicted by the numeral 50. The control circuit 50 comprises a difference detector 51, p-i controller 52 and pulse generator 53, the function of which will be hereinafter described. The sensor output signal is compared with a reference signal representative of a desired air/fuel ratio for instance of the stoichiometric value in the difference detector 51 which detects the difference between the two signals. The signal indicative of the differential value is then applied to the p-i (proportional integral) controller 52 to be subject to proportional and integral control providing an output signal as indicated by (b) of FIG. 2. The signal (b) transformed into a series of pulse signals in the pulse generator 53 depicted by (c) in FIG. 2, the widths of said pulse signals varying with the level of the signal (b). The pulse train from the pulse generator is applied to either the electromagnetic valve 32 or 33 to alternately open and close the valves. The rate of additional air passing through the additional air bleed passage and therefore also fuel delivery to the engine are thus controlled to a desired level, so that if the air/fuel ratio as represented by the sensed oxygen concentration in exhaust gases is substantially below the stoichiometric one, the total period of time for which the valve is open is prolonged to increase the rate of additional air being admitted into the main or slow fuel passage 20 or 21, and vice versa.

Of course, the system to which the improvement of this invention is applicable is not limited to the structure described above. For instance, the additional air bleed passages 30, 31 may be omitted and the electromagnetic valves may be disposed directly in the main and slow air bleeds 22 and 23.

The conventional system illustratively described however has encountered the following problems: The additional air bleed passage 31 is open during idle or low speed operation with the throttle valve being substantially closed. Also, it has to deliver a sufficient volume of air into the slow fuel passage 21 during transition from idle or low speed to high load, high speed operation, until sufficient fuel delivery takes place through the main fuel passage 20. If the electromagnetic valve 33 disposed in the passage 31 is properly acting, it depends on the diameter of an inlet jet 31' of the passage 31 whether the required volume of air is delivered to the fuel passage 21 or not. Usually, the diameter of the jet 31' is about 1 to 2 mm. If it is smaller than this size, the volume of air will be insufficient during the transient operation. If the jet size is as large as or larger than 1 to 2 mm, another problem arises such that too much air is delivered into the slow fuel passage 21 during idle or low speed running. This makes too great a difference between the air/fuel ratio of the mixture delivered to the engine during opening of the electromagnetic valve 33 and that during closure of the valve. This highly influences the idle or low speed running performance of the engine in which the total volume of engine intake air is limited, so that fuel flow into the engine pulsates upon each opening and closing of the valve 33, causing unstable running of the engine, so-called engine hunting.

Besides, during idle, the exhaust gas temperature is rather low so that the exhaust gas sensor fails to exhibit its preset characteristics. As a result, the electromagnetic valves do not properly operate or irregularly closed and open without being dependent on the actual air/fuel ratio of the mixture delivered to the engine. Thus, the additional air through the additional air bleed passage 31 highly fluctuates between zero and the maximum resulting too rich or too lean mixture. This will cause various troubles such that the too rich mixture entails increasing harmful exhaust emissions while the too lean mixture very likely causes misfiring and engine stalling.

Figure 3:
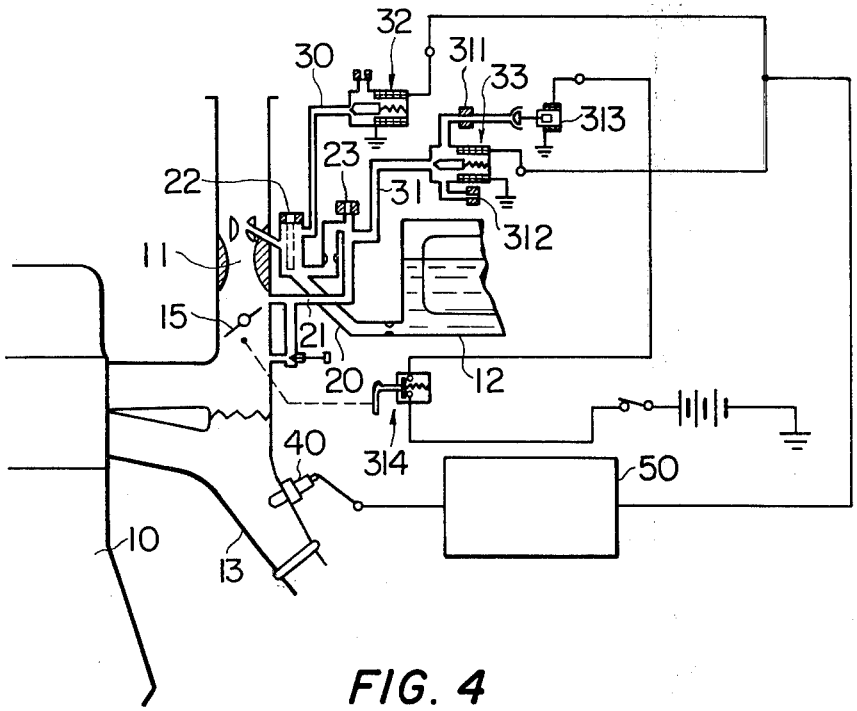
FIG. 3 is a view schematically showing a preferred embodiment of a feed back control system according to this invention.
Figure 4:
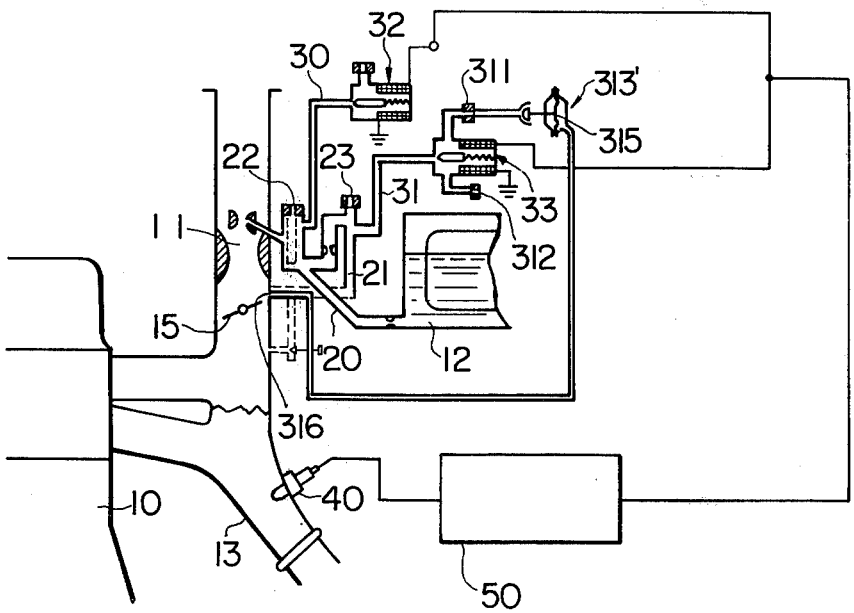
FIG. 4 is a view schematically showing another preferred embodiment of the system according to this invention.

The system according to this invention as illustrated in FIGS. 3 and 4 therefore contemplates to optimally control the air/fuel ratio to stabilize engine idling and to deliver a sufficient volume of additional air into the slow fuel passage during transition from idle to high speed — high load running.

As illustrated, the additional air bleed passage 31 is branched at the upstream portion of the electromagnetic valve 33 into two sections (no number) which have respectively inlets or jets 311 and 312 of different diameters. The sum of the different sizes of the jets 311 and 312 is made substantially equal to the size of a single jet of the conventional additional air bleed passage shown in FIG. 1, about 1 to 2 mm in diameter as previously mentioned. As shown, the jet 311 is of the larger size, while the size of the smaller jet 312 is made as small as to limit the volume of additional air passing therethrough enough to prevent engine hunting when the larger jet 311 is closed as will be further described. The larger jet 311 is selectively opened and closed by an electromagnetic valve 313 according to the preferred embodiment of FIG. 3. The electromagnetic valve 313 is electrically connected to a throttle position detector 314 of any known type which in turn is connected to the carburetor throttle valve 15. The throttle position detector 314 is responsive to full closure of the throttle to close the electromagnetic valve 313.

In operation, when the throttle valve assumes a more or less wide open position, the throttle position detector 314 is rendered inoperative so that the electromagnetic valve 313 is held in an open position. Consequently, air is admitted through both the larger jet 311 and smaller jet 312 into the additional air bleed passage 31, where the volume of air is controlled by the electromagnetic valve 33.

When the throttle valve is moved to a closed position with the engine idling, the throttle position detector 314 is operative to actuate the electromagnetic valve 313. The valve 313 then fully closes the larger jet 311. Thus, air flows solely through the smaller jet 312 via the additional air bleed passage 31 into the slow fuel passage 21 at the rate controlled by the electromagnetic valve 33.

It is apparent from the foregoing description that a sufficient volume of air is delivered into the slow fuel passage during the transient mode, whereas excessive air supply is prevented while the engine idles or runs at a low speed, providing stable engine operation. Since the air flow through the smaller jet 312 is extremely limited, the occasional variation in the volume of air flow does not materially influence engine idling, even though the electromagnetic valve 33 is irregularly opened and closed due to the low exhaust gas temperature. The overall system according to this invention thus exhibits a more precise control of the air/fuel ratio particularly during idle and transient conditions of the engine.

Shown in FIG. 4 is another preferred embodiment of the system according to this invention. In this embodiment, the larger jet 311 is opened and closed by a diaphragm-operable pneumatic valve 313', instead of the electromagnetic valve 313 in FIG. 3. The diaphragm assembly (no number) of the valve 313'is as usual operable by a differential pressure across the diaphragm. More specifically, the valve is closed by atmospheric pressure prevalent in a vacuum chamber 315 while it is maintained open when vacuum is applied to the diaphragm side facing the vaccum chamber. The vaccum chamber 315 communicates with the engine intake passage 11 through a hole 316 located immediately above the closed throttle. The hole 316 is preferably located in a position where a so-called vacuum control hole being employed in automotive vacuum-responsive spark timing control mechanisms is usually located, or, if equipped with such mechanism, the vacuum control hole itself may be utilized as an access to vacuum in the embodiment described.

As will be readily understood, when the throttle valve is open, the vaccum created in the intake passage is applied to the hole 316 whilst the substantially atmospheric pressure prevails in the hole 316 when the throttle is fully closed. The valve 313' is opened or closed with the vacuum or atmospheric pressure acting on the diaphragm, in a manner already described.

What is claimed is:

1. System to control ratio of air to fuel of air/fuel mixture being delivered to an internal combustion engine having an intake passage, an exhaust passage and a carburetor forming part of the intake passage, said carburetor having a throttle valve in the intake passage and a fuel delivery passage with a slow fuel passage for use in an engine idle condition, comprising means sensing in the exhaust gases in the exhaust passage, the concentration of a component which is variable in dependence on the ratio of air to fuel of the mixture and producing an electric signal representative of the sensed concentration of the component in the exhaust gases, passage means to conduct additional air into the slow fuel passage, said passage means having a first air inlet and a second air inlet disposed parallelly with the first air inlet and having an effective diameter which is substantially smaller than that of said first air inlet, electromagnetic means controlling the rate of air through the passage means in accordance with said electric signal, and means limiting the rate of air through said first air inlet in response to engine idling.

2. System according to claim 1, in which said slow fuel passage comprises a slow air bleed to feed air into the slow fuel passage and in which said passage means is disposed parallelly with said slow air bleed.

3. System according to claim 1, in which the limiting means comprises a throttle position detector operatively connected to the throttle valve to produce a throttle position signal indicating full closure of the throttle valve and an electromagnetic valve disposed in said first air inlet and electrically connected to said throttle position detector to be closed in response to said throttle closed position signal.

4. System according to claim 1, in which said limiting means comprises means defining a hole located immediately upstream of the closed throttle valve and a diaphragm-operable valve disposed in said first air inlet and having a vacuum chamber communicating with said hole, said diaphragm-operable valve being closed when atmospheric pressure is prevalent in said hole and is applied on the diaphragm.

5. In an air/fuel ratio control system of an internal combustion engine having an additional air bleed passage conducting additional air into a slow fuel passage of the engine being used during idle and slow running condition of the engine and means controlling the rate of additional air in accordance with an engine operating variable being related to the air/fuel ratio of the mixture being delivered to the engine, a first air inlet provided in said additional air bleed passage, a second air inlet provided parallelly with the first air inlet in said additional air bleed passage and having an effective diameter which is substantially smaller than that of said first air inlet, means responding to an idle engine condition and producing an idle signal indicative of the idle condition, valve means disposed in said first air inlet and operable to limit the rate of air therethrough in accordance with said idle signal.

6. An internal combustion engine comprising, in combination, and intake passage with a throttle valve, a fuel delivery means including a main fuel passage and a slow fuel passage adapted to deliver fuel into the intake passage in an engine idle condition, said slow fuel passage having a slow air bleed to freely conduct air into the slow fuel passage, an exhaust passageway, a catalytic converter disposed in said exhaust passageway through which the exhaust gases pass to be purified therein, means sensing a component of the exhaust gases in the exhaust passageway producing a signal which is variable in dependence on the ratio of air to fuel of the mixture said signal being representative of the concentration of the sensed component in the exhaust gases, a first additional air bleed passage to conduct additional air into the main fuel passage, a second additional air bleed passage communicating with said slow fuel passage parallelly with said slow air bleed to conduct additional air into the slow fuel passage, said second passage having a first air inlet and a second air inlet disposed parallelly with the first air inlet and having an effective diameter which is substantially smaller than that of said first air inlet, first electromagnetic means controlling the rate of air through the first additional air bleed passage in accordance with said signal, second electromagnetic means controlling the rate of air through the second additional air bleed passage in accordance with said signal, and means limiting the rate of air through said first air inlet in response to engine idling.

* * * * *